US006994605B2

(12) United States Patent
Baxter et al.

(10) Patent No.: US 6,994,605 B2
(45) Date of Patent: Feb. 7, 2006

(54) VIBRATORY AMUSEMENT DEVICE FOR PRODUCING CONCENTRIC ILLUMINATED RINGS

(75) Inventors: William Baxter, Jenkintown, PA (US); Kenneth Ho, Philadelphia, PA (US)

(73) Assignee: S. R. Mickelberg Company, Inc., Jenkintown, PA (US)

( * ) Notice: Subject to any disclaimer, the term of this patent is extended or adjusted under 35 U.S.C. 154(b) by 0 days.

(21) Appl. No.: 10/962,865

(22) Filed: Oct. 12, 2004

(65) Prior Publication Data

US 2005/0079790 A1 Apr. 14, 2005

Related U.S. Application Data

(60) Provisional application No. 60/511,151, filed on Oct. 14, 2003.

(51) Int. Cl.

| | |
|---|---|
| ***A63H 1/00*** | (2006.01) |
| ***A63H 1/24*** | (2006.01) |
| ***F21V 21/30*** | (2006.01) |
| ***F21V 21/32*** | (2006.01) |
| ***G09F 13/00*** | (2006.01) |

(52) U.S. Cl. ..... 446/236; 446/242; 446/485; 362/35; 362/250; 40/431

(58) Field of Classification Search ..... 446/236, 446/238, 242, 485, 219; 362/35, 197, 199, 362/234, 250; 40/431, 432, 502; 473/570; 273/454, 460; 463/37, 38, 8; 601/72, 73
See application file for complete search history.

(56) References Cited

U.S. PATENT DOCUMENTS

| | | | | |
|---|---|---|---|---|
| 1,548,615 | A * | 8/1925 | Krout | 40/432 |
| 1,651,244 | A * | 11/1927 | Becker | 446/238 |
| 1,700,590 | A * | 1/1929 | Lazar | 362/33 |
| 2,551,753 | A * | 5/1951 | McCullough | 362/8 |
| 3,037,322 | A * | 6/1962 | Baumgartner, Jr. | 446/242 |
| 4,097,917 | A | 6/1978 | McCaslin | |
| 5,422,796 | A * | 6/1995 | Peebles et al. | 362/102 |
| 5,453,036 | A | 9/1995 | Wisznia | |
| 6,227,929 | B1 | 5/2001 | Nelson et al. | |
| 6,413,144 | B1 | 7/2002 | Williams | |
| 6,524,073 | B2 | 2/2003 | Mnatsakanian | |
| 6,592,423 | B1 | 7/2003 | Boyle et al. | |
| 6,743,072 | B2 | 6/2004 | Nelson et al. | |
| 2003/0206412 | A1 * | 11/2003 | Gordon | 362/249 |
| 2004/0005841 | A1 * | 1/2004 | Chernick et al. | 446/242 |

* cited by examiner

*Primary Examiner*—Faye Francis
(74) *Attorney, Agent, or Firm*—Caesar, Rivise, Bernstein, Cohen & Pokotilow, Ltd.

(57) ABSTRACT

An illuminatable toy having a handle arranged to be held within the hand of a user and a pair of rotatable assemblies at opposite ends of the handle. Each assembly includes a pair of arms arranged to be rotated about a common longitudinal axis to create two concentric colored rings of light at each end of the device. The rotation of the arms about the axis causes the handle to shake in the hand of the user to enhance the amusement effect.

10 Claims, 1 Drawing Sheet

20
22
24
26
28
30
32
34
36
38
40
42
44
46
48
50
52
54
2
3

VIBRATORY AMUSEMENT DEVICE FOR PRODUCING CONCENTRIC ILLUMINATED RINGS

CROSS-REFERENCE TO RELATED APPLICATIONS

This application claims priority from provisional U.S. Patent Application No. 60/511,151, filed on Oct. 14, 2003 whose disclosure is incorporated by reference herein.

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPACT DISK

"Not Applicable"

BACKGROUND OF THE INVENTION

1. Field of the Invention

This invention relates generally to toys and particularly to pull-string motor actuated toys.

2. Description of Related Art

In U.S. Pat. No. 6,743,072 (Nelson et al.), there is disclosed an amusement devise used to move a supported display object through an erratic path. The amusement device includes a base element in which is disposed a motorized assembly. A support spring is used to interconnect a display object to the motorized assembly in the base element. The support spring has a first end and a second end. The first end of the support spring is coupled to the motorized assembly within the base element, wherein the support spring is caused to move by the vibrating assembly. The remainder of the support spring extends freely from the base element. The display object is coupled to the second end of the support spring. As the display object moves, it causes the support spring to oscillate, thereby causing the display object to move erratically from point to point.

In U.S. Pat. No. 6,227,929 (Nelson et al.) there is disclosed an amusement device used to move a supported display object through an erratic path. The amusement device includes a base element in which is disposed a rotating assembly. The rotating assembly can be battery powered, spring powered or manually powered. A support spring is used to interconnect a display object to the rotating assembly in the base element. The support spring has a first end and a second end. The first end of the support spring is coupled to the rotating assembly within the base element, wherein the support spring is rotated by the rotating assembly. The remainder of the support spring extends freely from the base element. The display object is coupled to the second end of the support spring. As the display object rotates, it causes the support spring to at least partially elongate, thereby causing the display object to move erratically from point to point.

In U.S. Pat. No. 6,413,144 (Williams) there is disclosed a hand-held toy that lights when spun, and which includes a rod, a head attached to, and spins with, the rod, a light source illuminates with movement of, the head, and apparatus associated with the light source, and which is grasped by the hands of a user. The head is either spherically-shaped or a pair of stacked disks. The light source includes a plurality of bulbs that are disposed on the head, a pair of battery interfaces that are in electrical communication with the plurality of bulbs and hold, and electrically communicate with, a pair of batteries, and a centrifugal switch that is electrical communication with the plurality of bulbs, and which closes when the head is spun, and when closed, illuminates the plurality of bulbs so as to allow the plurality of bulbs to illuminate when the head is spun. The apparatus includes a shell that rotatably receives the rod, and which is grasped by one hand of the user, a pull cord that normally winds around the rod and has a handle that is grasped by the other hand of the user, and when the shell is grasped by the one hand of the user, and the handle is grasped and pulled by the other hand of the user, the pull cord unwinds from the rod, which causes the rod to spin, which causes the head to spin, and which causes the light source to illuminate.

In U.S. Pat. No. 6,524,073 (Mnatsakanian), there is disclosed a continuous 3 twist, single surface, having threefold symmetry and dynamic properties. It spins with a slight flow of air in the direction of the axes, and when rotated about the axis of symmetry, it acts as a blade, propeller or fan, providing for a multiplicity of utilitarian, educational, entertainment and ornamental uses.

In U.S. Pat. No. 6,592,423 (Boyle et al.), there is disclosed a toy for producing a three dimensional aesthetically pleasing illuminated image. The toy includes a handle, a light source, a rotary drive mechanism, and a plate-like member having an outer surface at least a portion of which is a holographic diffraction surface. The plate-like member is arranged to be rotated about a longitudinal axis so that light received by the holographic diffraction surface produces an aesthetically pleasing illuminated three-dimensional image. The plate-like member can be mounted so that it moves along the axis with respect to the handle as it is rotated and can include a transparent sphere containing a three dimensional object, e.g., a cartoon character, therein.

In U.S. Pat. No. 5,453,036 (Wisznia), there is disclosed a one piece spinning toy with markings made of either luminous or fluorescent material. When the toy is spun, it spins at an angle rather than upright, which creates a wobbling effect that causes the markings to generate a clear three-dimensional pattern.

In U.S. Pat. No. 4,097,917 (McCaslin), there is disclosed a light display which rotates in response to command signals in the form of sounds, light beams or the like. The display includes a tube having flexible rod-like members coupled thereto and extending outwardly therefrom with the outer ends of the members being provided with essentially point sources of light which, when the tube rotates, trace out generally continuous lines due to the relatively high speed of rotation of the tube. The tube rotates under the influence of an electric motor which receives command signals for causing rotation of the drive shaft thereof. The drive shaft is either connected directly or by gear-down structure to the tube. One embodiment of the invention utilizes the rod-like members which are flexible glass fibers and a light source is disposed to the outer ends thereof. In another embodiment, the members are tubes having light emitters such as light diodes at their outer ends.

Various toys or amusement devices to create spinning rings of light are commercially available.

While all of the foregoing toys may be suitable for their intended purposes, they all leave something to be desired from the standpoint of the entertainment value that they provide.

BRIEF SUMMARY OF THE INVENTION

A toy for producing an aesthetically pleasing display made up of two pairs of concentric illuminated rings. The toy comprises an elongated body arranged to be held in the hand of a user and having a first end and a second end and a longitudinal axis, a first long arm and a first short arm, a second long arm and a second short arm, a motor, and an actuator. The motor is located within the body. The actuator is mounted so that a portion of it is exposed at the body to be depressed by the user, e.g., a child, when the user desires to operate the device.

The first long arm is located at the first end of the elongated body and directed away from the longitudinal axis in a first radial direction. The first short arm is located at the first end of the body diametrically opposite the first long arm and is directed away from the longitudinal axis in an opposite radial direction. The first long arm and the first short arm each include an illuminatable element, e.g., a lamp, located adjacent a free end thereof. The second short arm is located at second end of the body and directed away from the longitudinal axis in the first radial direction. The second long arm is located at the second end of the elongated body diametrically opposite the second short arm and is directed away from the longitudinal axis in the opposite radial direction. The second long arm and the second short arm each include an illuminatable element, e.g., a lamp, located adjacent the free end thereof.

All of the arms are arranged to be rotated about the longitudinal axis by actuation of the actuator, whereupon the illuminatable elements illuminate to create a first pair of concentric light rings at the first end of the body and a second pair of concentric light rings at the second end of the body. Moreover, the rotation of the arms causes the body to vibrate or shake in the hand of the user.

DETAILED DESCRIPTION OF THE INVENTION

DETAILED DESCRIPTION OF THE PREFERRED EMBODIMENT

Figures 1, 2, 3:
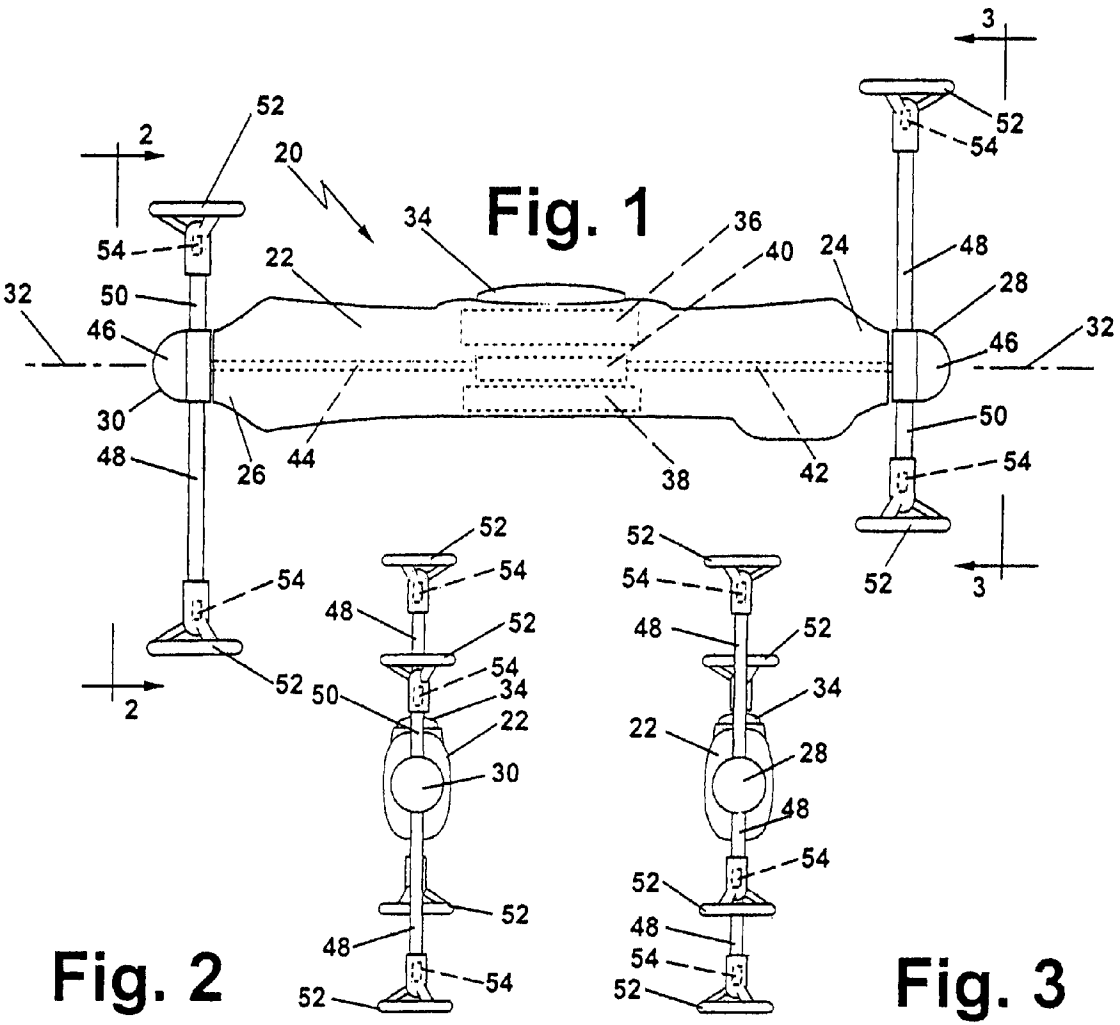
FIG. 1 is a plan view of one exemplary embodiment of a toy constructed in accordance with this invention and shown in it normal condition, prior to its pull-string being pulled to effect the operation of the toy.
FIG. 2 is an end view taken along line 2—2 of FIG. 1.
FIG. 3 is an end view taken along line 3—3 of FIG. 1.

Referring now to the various figures of the drawing wherein like reference characters refer to like parts, there is shown in FIG. 1 one exemplary embodiment of a toy 20 constructed in accordance with this invention.

The toy 20 basically comprises a body 22 having a first end 24 and a second end 26 at which respective rotatable assemblies 28 and 30, respectively, are mounted. The body 22 is an elongated hollow member having a longitudinal axis 32 and is arranged to be held in the hand of a user. The body 22 includes an actuator switch 34 mounted on it at approximately the middle of the handle. The transverse cross sectional area of the handle is such that it can be held comfortably within the hand of a child, so that the child's fingers can depress the actuator switch when desired. The actuator switch 34 is connected, via electrical conductors (not shown), to an electronic circuit 36, a battery pack 38, and an electrical motor 40 located within the hollow interior of the body. A pair of elongated drive shafts 42 and 44 project out of the motor 40 and are axially aligned with the longitudinal axis 32. The drive shafts are arranged to be rotated at a high rate of speed in unison when the motor is operated. The motor operates, when the actuator switch 34 is depressed.

The rotatable assemblies 28 and 30 are of similar construction. In particular, the first assembly 28 basically comprises a central hub 46 mounted on the free end of the drive shaft 42, while the second assembly 30 comprises a central hub 46 mounted on the free end of the drive shaft 44. Each hub is arranged to be rotated about the longitudinal axis when the motor is operated. The first assembly 28 includes a first long arm 48 and a first short arm 50 mounted at diametrically opposed positions on the hub. Each arm is flexible so that when the hub is rotated, each arm extends generally outward radially. At the free end 52 of each arm is an aesthetically pleasing illuminatable end member formed of a transparent or translucent material and having a lamp or LED 54 located therein. The lamp or LED is connected to a pair of electrical conductors (not shown) extending through the arm and electrically coupled to the electrical circuit within the body 22, whereupon when the actuator is depressed, the lamp or LED illuminates. Preferably the color of the end member on the first long arm is different than the color of the end member of the first short arm, e.g., the first long arm is blue and the first short arm is red. Accordingly, when the actuator switch is depressed the lamps/LEDs will illuminate as the arms are spun. The illuminated lamps/LEDs on the ends of the rotating arms thus creates the appearance of two concentric illuminated rings of light at the first end of the device 20. In this exemplary embodiment there will be a blue ring and a red ring located within and concentric with the blue ring. In the interest of aesthetics the first long arm and the first short arm are each transparent so that when the arms are rotated they tend to become invisible, thereby further enhancing the appearance of the concentric light rings.

The second assembly 30 includes a second long arm 48 and a second short arm 50 mounted at diametrically opposed positions on the hub but oriented differently than the arms 48 and 50 of the first assembly (as will be described later). Each arm of the second assembly is also flexible so that when the hub is rotated, each arm extends generally outward radially. An aesthetically pleasing illuminatable end member formed of a transparent or translucent material and having a lamp or LED 54 located therein is mounted on the end of each arm of the second assembly 30. Each lamp of that assembly is connected to a pair of electrical conductors (not shown) extending through the associated arm and electrically coupled to the electrical circuit within the body 22. Accordingly, when the actuator is depressed, those lamps/LEDs illuminate. Preferably the color of the end member on the second long arm is different than the color of the end member of the second short arm and is different from the colors of the end members of the first long arm and first short arm of the first assembly. Thus, in one exemplary embodiment of this invention the second long arm is green and the second short arm is yellow. As with the first assembly the second long arm and the second short arm are each transparent. Accordingly, when the actuator switch is depressed the lamps/LEDs on the second long arm and second short arm will illuminate as the arms are spun to create the appearance of a green illuminated ring and a yellow illuminated ring located concentrically within the green ring at the second end of the device.

As should be appreciated by those skill in the art the rotary illumination action as just described creates a very pleasing visual appear or display to provide enjoyment to the child using the device. In order to further enhance the joy of using the device, the device is constructed so that when it is operated it will vibrate or otherwise shake in the hand of the user (child). To that end the rotatable assemblies 28 and 30 are oriented so that the first long arm is directed away from the longitudinal axis in a first radial direction and the second short arm is directed away from that axis in that same radial direction, while the first short arm and the second long arm are directed away from the longitudinal axis in a second and opposite direction. Accordingly, the arms at each end of the device extending in the first radial direction are unbalanced as are the arms extending in the second (opposite) radial direction, so that when the arms are rotated this imbalance causes the body 22 to shake or vibrate in the hand of the child.

Without further elaboration the foregoing will so fully illustrate my invention that others may, by applying current or future knowledge, adopt the same for use under various conditions of service.

We claim:

1. A toy for producing an aesthetically pleasing display of concentric illuminated rings, said toy comprising an elongated body arranged to be held in the hand of a user and having a first end and a second end and a longitudinal axis, a first long arm and a first short arm, a second long arm and a second short arm, a motor, and an actuator, said motor being located within said body, said actuator being mounted so that a portion thereof is exposed at said body, said first long arm being located at said first end of said elongated body and directed away from said longitudinal axis in a first radial direction, said first short arm being located at said first end of said body diametrically opposite said first long arm and directed away from said longitudinal axis in an opposite radial direction, said first long arm and said first short arm each including an illuminatable element located adjacent a free end thereof, said second short arm being located at second end of said body and directed away from said longitudinal axis in said first radial direction, said second long arm being located at said second end of said elongated body diametrically opposite said second short arm and directed away from said longitudinal axis in said opposite radial direction, said second long arm and said second short arm each including an illuminatable element located adjacent the free end thereof, all of said arms being arranged to be rotated about said longitudinal axis by actuation of said actuator, whereupon said illuminatable elements illuminate to create a first pair of concentric light rings at said first end of said body and a second pair of concentric light rings at said second end of said body, and whereupon the rotation of said arms causes said body to vibrate in the hand of the user.

2. The toy of claim 1 wherein said illuminatable element comprises a lamp or LED.

3. The toy of claim 1 wherein each of said arms is a flexible member.

4. The toy of claim 1 wherein the color of the illumination produced at each of the arms is different.

5. The toy of claim 1 wherein each of the arms is formed of a transparent or translucent material.

6. The toy of claim 2 wherein each of said arms is a flexible member.

7. The toy of claim 2 wherein the color of the illumination produced at each of the arms is different.

8. The toy of claim 2 wherein each of the arms is formed of a transparent or translucent material.

9. The toy of claim 3 wherein each of the arms is formed of a transparent or translucent material.

10. The toy of claim 4 wherein each of the arms is formed of a transparent or translucent material.

* * * * *